United States Patent [19]

Linstedt et al.

[11] 3,949,722

[45] Apr. 13, 1976

[54] SEMICONDUCTOR CONTROLLED IGNITION SYSTEMS FOR INTERNAL COMBUSTION ENGINES

[75] Inventors: Hans Linstedt, Reutlingen; Helmut Roth, Stuttgart; Götz Bundschuh, Gerlingen; Gerd Höhne, Ludwigsburg; Bernd Bodig, Leinfelden; Gert Strelow, Stuttgart; Peter Schmidt, Munklingen; Gerhard Söhner, Geradstetten; Herman Roozenbeek, Schwieberdingen; Hartmut Michel, Reutlingen, all of Germany

[73] Assignee: Robert Bosch G.m.b.H., Gerlingen-Schillerhöhe, Germany

[22] Filed: July 23, 1974

[21] Appl. No.: 491,047

[30] Foreign Application Priority Data

Aug. 7, 1973 Germany ..... 2339896

[52] U.S. Cl. ..... 123/148 E; 315/209 T

[51] Int. Cl.[2] ..... F02P 3/02

[58] Field of Search ..... 123/148 E; 315/209 T

[56] References Cited

UNITED STATES PATENTS

| | | | |
|---|---|---|---|
| 3,749,974 | 7/1973 | Kissel | 123/148 E |
| 3,750,638 | 8/1973 | Tanaka | 123/148 E |
| 3,762,383 | 10/1973 | Richards et al. | 123/148 E |
| 3,831,570 | 8/1974 | Compton et al. | 123/148 E |
| 3,841,288 | 10/1974 | Kortelmg | 123/148 E |

*Primary Examiner*—Wendell E. Burns
*Assistant Examiner*—James W. Cranson, Jr.
*Attorney, Agent, or Firm*—Flynn and Frishauf

[57] ABSTRACT

To improve the operation of semiconductor control ignition systems under widely varying supply voltage conditions, a voltage divider having a division tap point is connected in parallel to the main switching part of the switching transistor of the ignition system, and a voltage breakdown element, typically a Zener diode is connected from the tap point to the control electrodes of the semiconductor switch to provide an additional control voltage thereto if the voltage at the tap point exceeds a value leading to breakdown of the breakdown device (Zener diode); the main control circuit for the main ignition transistor may be conventional.

10 Claims, 1 Drawing Figure

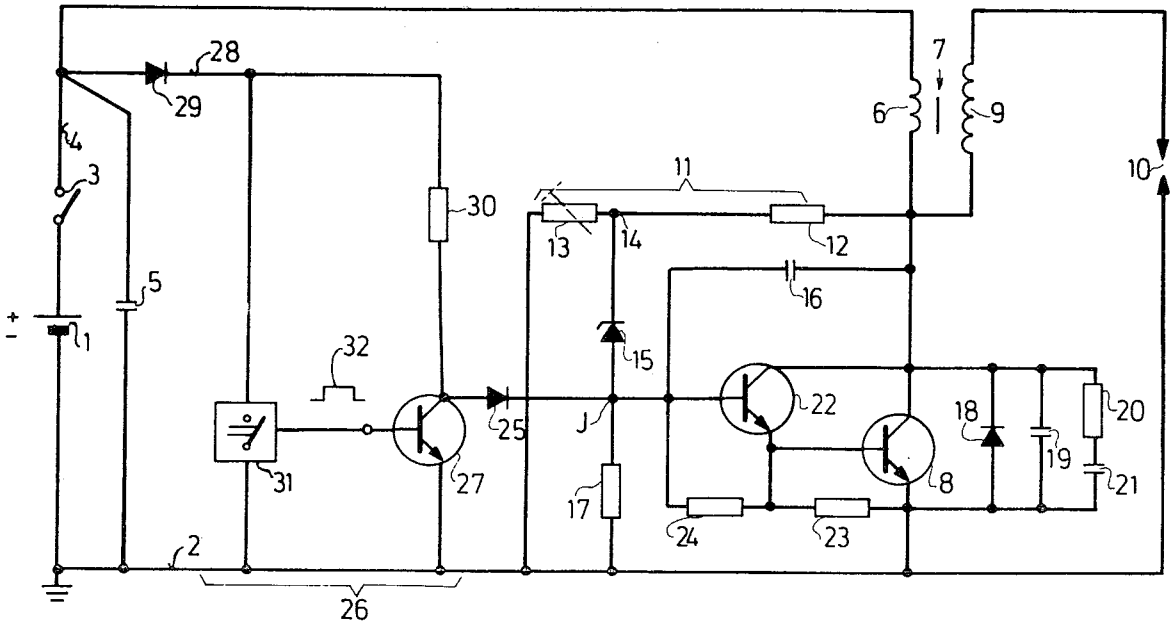
10
9
7
6
20
21
19
18
8
12
16
22
23
11
24
14
15
13
17
25
30
27
32
26
31
28
29
5
2
4
3
1
+
-

SEMICONDUCTOR CONTROLLED IGNITION SYSTEMS FOR INTERNAL COMBUSTION ENGINES

The present invention relates to an ignition system for internal combustion engines and more particularly to a transistorize ignition system in which current flow to the primary winding of an ignition coil, or ignition transformer is controlled by a switching transistor.

Transistorized switching systems which use ignition coils have the advantage that mechanical breaker contacts, controlling these ignition systems, are subject to only little wear, or may readily be replaced by contact-less breaker elements. Additionally, transistorized ignition systems can be so designed that sufficient ignition voltages, causing sparking at the spark plugs can be obtained even if the voltage of the main power supply drops to half of its nominal value. When the voltage of the voltage source — typically the battery of an automotive vehicle — reaches nominal value, high voltages arise at the switching transistor upon transition of its main current carrying path from current carrying, open state to blocked state. It is therefore necessary to provide a circuit which limits the voltages across the switching transistor to prevent damage to the switching transistor due to over voltages, or, alternatively, to utilize a switching transistor which can stand very high voltages, which, therefore, is very expensive. It has been proposed to limit the voltages by placing a Zener diode in parallel to the switching path of the switching transistor, the Zener diode being poled in blocking direction, with respect to the current supply source. The Zener diode, upon breakdown, limits the voltage across the emitter-collector terminals of the switching transistor. The voltage to which the emitter-collector terminals of the switching transistor is limited is, however, not a fixed, determinable value but, rather, is subject to substantial fluctuations. The spread, or range of voltage across the emitter-collector terminals of the switching transistor, upon transition from conductive, to blocked state, is wide.

It is an object of the present invention to improve a semiconductor controlled ignition system in which the switching transistor is protected from high voltages by a simple, reliable circuit, and in which the design values of maximum voltages can be maintained without undue spread of this range.

SUBJECT MATTER OF THE PRESENT INVENTION

Briefly, a voltage breakdown element, such as a Zener diode is connected not across the emitter-collector path of the switching transistor, but rather from a voltage level sensing circuit — for example a voltage divider — to the control electrodes of the semiconductor switch, typically to the base of the switching transistor. This voltage breakdown device then provides an additional control voltage to the base of the semiconductor switch, to modify the control voltages applied thereto by the ignition control circuit, if the voltage breakdown element has broken down. Thus, if excessively high voltages should arise, an additional control voltage is applied to the semiconductor, to so modify its conduction characteristics — or the time of change — over of its conduction characteristics — that excessively high voltages are avoided.

The invention will be described by way of example with reference to the accompanying drawing, wherein the single FIGURE is a schematic circuit diagram, omitting non-essential elements, of an ignition system.

A battery 1, typically an automotive vehicle battery of, for example, 12V nominal, is connected with its negative terminal to a chassis or ground connection 2 and with its positive terminal over an ignition switch 3 to a positive bust 4. A stabilizing capacitor 5 is connected between bus 4 and chassis 2. Bus 4 is connected to the primary winding 6 of an ignition coil or transformer 7. Serially connected with the primary winding 6 of coil 7 is the emitter-collector path of an npn switching transistor 8, the emitter of which is connected to chassis 2. The secondary 9 of ignition coil 7 is connected to a spark plug 10. Of course, more than one spark plug may be provided, suitably connected in time sequence by a distributor (not shown).

A voltage divider 11, operating as a voltage sensing element is connected in shunt to the emitter-collector path of the switching transistor 8. Voltage divider 11 is formed of two resistors 12, 13 of which resistor 13 is a variable or adjustable resistor, serially connected at a junction or tap point 14. The junction or tap point 14 is connected to one terminal of a voltage sensitive breakdown switching element 15, typically a Zener diode, connected in blocking direction with respect to the polarity of battery 1. The other terminal of Zener diode 15 is formed by a junction J which is connected to the base, or control electrode of transistor 8. A Zener diode is preferred for use of the voltage breakdown element 15, although it may be a different type element. Junction J is connected over a capacitor 16 to the active terminal of the voltage divider 11, that is, to the common terminal formed by coil 6, voltage divider 11, and the collector of transistor 8. A control resistor 17 connects junction J to chassis bus 2, to which, also, the other terminal of resistor 13 is connected.

A diode 18, poled in blocking direction (with respect to battery 1) is connected across the collector-emitter path of transistor 8 and hence in parallel to the voltage divider 11. Further, a protective capacitor 19 is connected across the voltage divider 11, as well as a series circuit formed of a resistor 20 and a capacitor 21, of small value. Preferably, capacitor 19 is connected at the collector-emitter terminals of transistor 8, and connected close thereto with leads or connections as short as possible.

A preamplifying transistor 22 connects from junction J to the base of transistor 8; transistors 22 and 8 are connected in a Darlington circuit; two stabilizing resistors 23, 24 are connected between the emitters and bases of the respective transistors 8 and 22.

Control voltages are applied to the base of transistor 22, that is to junction J over a trigger circuit shown schematically. A diode 25, poled in conductive direction is connected to the collector of a transistor 27. Transistor 27 is supplied from batter 1 over a diode 29, a supply line 28 and a load or collector resistor 30. The transistor 27 is gated ON by a switch 31 which may, for example, be the breaker contact of the internal combustion engine ignition system, a contact-less controller, or the like. The entire control circuit, collectively indicated at 26 provides pulses 32 to suitably control current flow through the emitter-collector path of transistor 8. Switch 31 is connected to control transistor 27 to be conductive during the duration of a positive control pulse 32 applied to the base of transistor 27.

OPERATION

The system is rendered operative by closing of the main, or ignition switch 3. Let it be assumed that the breaker switch 31 is closed. Transistor 27 therefore will be blocked, and its emitter-collector path will be non-conductive. Transistor 22, as well as main switching transistor 8 will have a conductive emitter-collector path. Current will flow through primary winding 6 of the ignition coil 7. As soon as switch 31 provides a pulse, due to opening thereof, transistor 27 will change over so that its emitter-collector path will become conductive. This controls the transistor 22, as well as the main switching transistor to blocked state, so that its emitter-collector path will become highly resistive, thus, effectively, interrupting current flow through primary winding 6. This sudden interruption results in a high voltage pulse in the secondary winding 9, and spark plug 10 will have an electric spark appear thereat.

Upon transition of the switching path of switching transistor 8 from conductive into blocked state, the voltage there across may exceed a permissible limiting value. If this permissible limiting value is exceeded, the voltage breakdown element (preferably a Zener diode) will break down. Tap point 14 of the voltage divider 11 will not be connected to junction J and hence current can flow over the control paths of the transistors 22 and 8 which tends to control the transistors 22 and 8, each, to again become current conductive. This action, continued current flow through the primary 6 of the ignition coil changes the time rate-of-change of current flow therethrough, and thus causes a drop in the voltage of the pulse across the switching path of the switching transistor 8 until the voltage thereat drops below the breakdown voltage of the breakdown element 15. Resistors 12, 13, of the voltage divider 11 will always remain, continuously, in parallel to the main switching path of transistors 8, 22. Ignition, itself, is not interfered with.

The interaction of the circuit formed by the breakdown element 15, preferably a Zener diode, and of transistors 22 and 8 provide for a well temperature compensated limiting value of the permissible voltage across the switching path of switching transistor 8. Tolerances and inaccuracies in values of the switching elements do not materially affect this limiting value, by suitable adjustment or setting of the voltage divider 11. Voltage divider 11 should be so set that it provides just permissible low resistance value. Tolerances can be compensated by suitable adjustment of the division ratio of the voltage divider 11, for example by adjustment of the resistor 13 which, preferably, should be made to be adjustable. Diode 25 insures that a control circuit for the emitter-collector path of the transistors 22 and 8 does not bypass over the emitter-collector path of the control transistor 27. Additionally, it provides a circuit element which reliably switch control of the transistors 22 and 8 to change into non-conductive state upon switch-over of the control transistor 27.

Capacitor 16 has the function to prevent oscillations upon control of the voltage across the main switching path of the switching transistor 8.

Diodes 18 and 29 have the function to prevent damage to the system upon inadvertently reverse connection thereof to the current source 1 (or inadvertent connection of current source 1 with reverse polarity into an automotive system).

Capacitor 19 protects the system from high frequency voltage peaks. If capacity should be small and it should be placed close to the connection of the switching transistor 8, preferably by leads of minimum size.

Capacitor 21 prevents oscillations which might arise due to the inductance of the ignition transformer 7. Resistor 20 limits discharge current from capacitor 21 and flowing over the switching path of the transistor 8.

Various changes and modifications may be made within the scope of the inventive concept.

We claim:

1. Ignition system for internal combustion engines having a series circuit including a current source (1), the primary (6) of an ignition transformer (7) and a semiconductor ignition current switching means (8, 22)

characterized by a voltage divider (11) including two resistors (12, 13) and having a division tap point (14), the voltage divider being permanently and continuously connected in parallel to the switching path of the semiconductor switching means (8, 22);

and a voltage sensitive breakdown element (15) of predetermined voltage breakdown characteristic connected with one terminal to the tap point (14) of the voltage divider and with the other terminal (J) to the control electrode of the semiconductor switching means (8, 22) to provide an additional control voltage thereto if the voltage sensed by said sensing means exceeds a value leading to breakdown of said voltage sensitive means.

2. System according to claim 1 wherein the voltage sensitive breakdown element comprises a Zener diode (15).

3. System according to claim 1 further comprising a resistor (17) connecting the other terminal (J) of the voltage breakdown element (15) which is connected to the semiconductor switching means (8,22) to an end terminal of the voltage divider (11), to provide, upon breakdown of said element (15), control current flow through said element (15) and establish a predetermined voltage level at the other terminal (J) of the breakdown element and hence at the control electrode of the semiconductor switching means (8, 22).

4. System according to claim 3 further comprising a control circuit (26) for the control electrode of the semiconductor switching means (8, 22) connected to said other terminal (J), comprising a diode (25) connected with one terminal to the other terminal (J) and poled in conductive direction with respect to the supply voltage for the system;

a control switching transistor (27) having its switching path connected to an end terminal of the voltage divider (11) and the other terminal connected to the other terminals of the diode (25);

a polarity protective diode (29) connected between the supply terminal of the voltage supply for the system and the emitter-collector path of the control wswitching transistor (27);

and means (31) controlling conduction of the control switching transistor (27) to control ignition pulses for the system.

5. System according to claim 1 further comprising a capacitor (16) connecting the other terminal, with and end terminal of the voltage divider (11) to prevent oscillations at the other terminal (J) due to the L/R circuit formed by the ignition transformer (7) in circuit with the voltage divider (11) and with said semiconductor switching means (8, 22).

6. System according to claim 1 further comprising a diode (18) connected across the voltage divider (11) and polarized in blocking direction with respect to the supply voltage for the system.

7. System according to claim 1 further comprising a protective capacitor (19) connected across the voltage divider (11).

8. System according to claim 7 wherein the capacitor (19) is physically located close to the semiconductor switching means (8, 22) and has a capacity which is small with respect to the capacity of the remainder of the circuit.

9. System according to claim 1 further comprising a series R/C circuit (20, 21) connected in parallel to the voltage divider (11) and the switching path of the semiconductor switching means (8, 22).

10. System according to claim 1, wherein the semiconductor switching means comprises a main current carrying transistor (8) and an auxiliary transistor (22), said main and auxiliary transistors being connected in a Darlington circuit, the auxiliary transistor (22) having its base connected to said other terminal (J) of the voltage breakdown element.

* * * * *